United States Patent [19]

Gladstone

[11] 4,193,549

[45] Mar. 18, 1980

[54] ARM/ROTOR HUB ASSEMBLY

[75] Inventor: Joseph Gladstone, Teaneck, N.J.

[73] Assignee: Beatrice Foods Co., Chicago, Ill.

[21] Appl. No.: 927,103

[22] Filed: Jul. 24, 1978

[51] Int. Cl.[2] ..... B05B 3/06

[52] U.S. Cl. ..... 239/251; 239/600

[58] Field of Search ..... 239/116, 251, 600, 487, 239/489; 29/509, 512, 523; 285/192; 403/193, 194, 242, 248

[56] References Cited

U.S. PATENT DOCUMENTS

| | | | |
|---|---|---|---|
| 1,647,447 | 11/1927 | Harnett | 403/242 |
| 1,766,514 | 6/1930 | Henry | 239/251 |

*Primary Examiner*—James B. Marbert

*Attorney, Agent, or Firm*—James & Franklin

[57] ABSTRACT

An arm/rotor hub assembly comprises a hollow rotor and a plurality of hollow arms, each of the arms passing through a corresponding aperture of the rotor sidewall and having one end thereof extending outwardly of the rotor in a generally transverse direction and the other end thereof disposed within the rotor and flared outwardly to a diameter greater than that of the corresponding aperture. The inner surface of the rotor sidewall defines a recess adjacent each of the apertures, and the rotor other ends have a portion thereof at least partially disposed within the recess adjacent the corresponding aperture. The assembly is put together by inserting the other arm ends through the corresponding apertures and employing a flaring tool inserted into the rotor through the open rotor end to flare the other arm ends outwardly within the rotor to a diameter greater than the apertures and force some portions of the other arm ends into the recesses and other portions intermediate the apertures and the open rotor end.

19 Claims, 11 Drawing Figures

ARM/ROTOR HUB ASSEMBLY

BACKGROUND OF THE INVENTION

The present invention relates to an arm/rotor hub assembly and a method of assembling the same, and more particularly to such an assembly in which the arms pass through apertures in the rotor sidewall and are flared outwardly within the rotor to a diameter greater than that of the apertures.

Arm/rotor hub assemblies are utilized in a variety of different applications, one common application being the stationary or rotating garden sprinkler. In the sprinkler application, the interior of an upright, generally cylindrical hollow rotor is in fluid communication with a fluid supply (for example, by means of a flexible hose). Transversely-extending hollow arms pass through the rotor sidewall and are in fluid communication with the interior of the rotor, the outwardly extending ends of the arms being typically provided with nozzles communicating with the rotor interior through the hollow arms. The length of the sidewall of the arm portion extending outwardly from the rotor may also be provided with small apertures (whether also equipped with nozzles or not) to provide additional means of egress for the water.

Clearly a critical consideration in such an assembly is that the rotor/arm interface is fluid-tight so that fluid does not leak out of the rotor interior through the interface and accumulate on the ground immediately adjacent to the rotor. Furthermore, the assembly must be sufficiently strong to prevent such leakage of water through the interface even at elevated water pressure, such as 125 psig. Usually as part of the technique for preventing such leakage, and in any case in order to insure that the spray pattern of the sprinkler remains constant, the arms should be constrained from movement relative to the rotor. Finally, the method of assembling the arms to the rotor should be simple, inexpensive, and relatively fail-proof.

Accordingly, it is an object of the present invention to provide an arm/rotor hub assembly in which the arm/rotor interface is substantially fluid-tight.

Another object is to provide such an assembly which substantially precludes motion of the arms relative to the rotor.

A further object is to provide a simple, inexpensive and relatively fail-proof method of assembling such an arm/rotor hub assembly.

SUMMARY OF THE INVENTION

It has now been found that the above and related objects of the present invention are obtained in an arm/rotor hub assembly in which each arm end within the rotor is flared outwardly to a diameter greater than that of the aperture in the rotor sidewall through which it passes and in which the arm end includes a portion thereof at least partially disposed intermediate the corresponding aperture and the open rotor end.

More particularly, the arm/rotor hub assembly comprises a hollow rotor and a plurality of hollow arms. The hollow rotor is adapted to receive a plurality of transversely-extending arms and has an open end, an opposite end, and a sidewall intermediate the ends. The sidewall defines a like plurality of apertures therethrough. Each of the arms passes through a corresponding one of the apertures and has one end thereof extending outwardly of the rotor in a generally transverse direction and the other end thereof disposed within the rotor. The end within the rotor is flared outwardly to a diameter greater than that of the corresponding aperture and has a portion thereof at least partially disposed intermediate the corresponding aperture and the open rotor end.

In a preferred embodiment characterized by enhanced rigidity of the connection between the arms and the rotor, the inner surface of the rotor sidewall defines a recess adjacent each of the apertures and each of the arm ends within the rotor includes a portion thereof at least partially disposed within a recess. Preferably each recess is disposed intermediate its corresponding aperture and the opposite rotor end, and communicates with its corresponding aperture as well as all other recesses.

Preferably the plurality of apertures are disposed in a common transverse plane with the other end of one of the arms abutting the other end of at least one other of the arms to limit inward motion of the abutting arms relative to the rotor. Portions of the other arm ends disposed to one side of the common transverse plane extend into the recesses and portions of the other arm ends disposed to the opposite side of the common transverse plane extend parallel to the rotor sidewall.

The arm/rotor hub assembly is assembled, using a rotor as described above, by inserting one end of each hollow arm through a corresponding aperture and employing a flaring tool inserted into the rotor through the open rotor end to flare the one arm ends outwardly within the rotor to a diameter greater than the apertures and force portions of the one arm ends intermediate the apertures and the open rotor end, preferably until the portions extend substantially parallel to the rotor sidewall.

In a preferred embodiment of this assembly method for use where the inner surface of the sidewall further defines a recess adjacent each of the apertures intermediate the aperture and the opposite rotor end, the flaring tool is employed to force portions of the one arm ends into the recesses intermediate the apertures and the opposite rotor end as well.

Preferably the one arm ends are inserted until the one arm ends flare outwardly and abut. If desired, the head may be rotated during the insertion step.

In an especially preferred embodiment of this assembly method, a flaring tool having a flaring head is inserted into the rotor through the open rotor end until the head is disposed in a common transverse plane defined by the apertures and extends at least slightly to either side thereof. One end of each arm is then inserted through its corresponding aperture in the common transverse plane and against the flaring head, thereby to flare outwardly within the rotor the other arm ends to a diameter greater than the apertures. The flaring head is then withdrawn from the rotor through the open rotor end, thereby to force portions of the one arm ends intermediate the apertures and the open rotor end. Where the inner surfaces of the rotor sidewall further define a recess adjacent each of the apertures intermediate the aperture and the opposite rotor end, after insertion of the arms into the rotor and before withdrawal of the flaring head from the rotor, the flaring head is driven a limited distance in the direction of the opposite rotor end, thereby to force portions of the one arm ends into the recesses intermediate the apertures and the opposite rotor end.

DETAILED DESCRIPTION OF THE PREFERRED EMBODIMENTS

Figure 1:
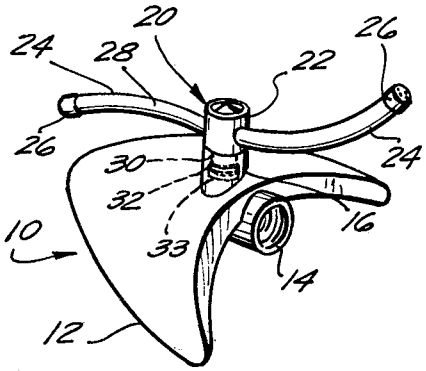
FIG. 1 is an isometric view of a sprinkler incorporating the assembly of the present invention.

Referring now to the drawing, and in particular to FIG. 1 thereof, therein illustrated is a rotating sprinkler, generally designated 10, which embodies the arm/rotor hub assembly of the present invention. The base 12 of the sprinkler is adapted to rest upon the ground and includes an internally threaded inlet opening 14 adapted to receive an externally threaded end of a hose (not shown) and upstanding hollow outlet neck 16 in fluid communication with the inlet opening 14. Press-fit vertically into the neck 16 is a hub assembly, generally designated 20, comprising a rotor 22 and a pair of arms 24.

The base 12 and rotor 22 are preferably formed of plastic, the engagement of the two (as described hereinbelow) enabling the rotor 22 to rotate relative to the base 12. The arms 24 are formed of metal and are curvilinear, the outer end of each arm 24 being provided with a nozzle 26. If desired, the portion of the arm 24 extending outwardly from the rotor 22 may be provided with one or more holes 28 to insure that water is sprayed immediately adjacent the base 12 (where the water being sprayed from nozzle 26 does not reach). Water or other fluid from the hose enters the inlet 14, passes upwardly through the neck 16 into the rotor 22, and then passes through the arms 24, emerging from the holes 28 and nozzles 26. The arms 24 are configured to insure that the fluid escaping from the nozzle 26 causes the hub assembly 20 to rotate relative to the base 12, so that the sprinkler 10 effects watering over a circular or annular area over a period of time.

Mounted on the exterior sidewall of the bottom portion of the rotor 22 are a metal bushing 30 and, below that, washer 32. In order to prevent the bushing 30 and washer 32 from sliding downwardly off the rotor 22, the bottom 34 of the rotor 22 is flared out by conventional techniques (generally, but not necessarily after formation of the assembly) to form an outwardly extending lip of greater outer diameter than the inner diameter of washer 32. The exterior sidewall of bushing 30 is provided with circumferentially extending ridges which are snugly engaged by the interior of neck 16 to enable rotation of the hub assembly 20 relative to the base 12 while precluding axial displacement therefrom.

Figure 3:
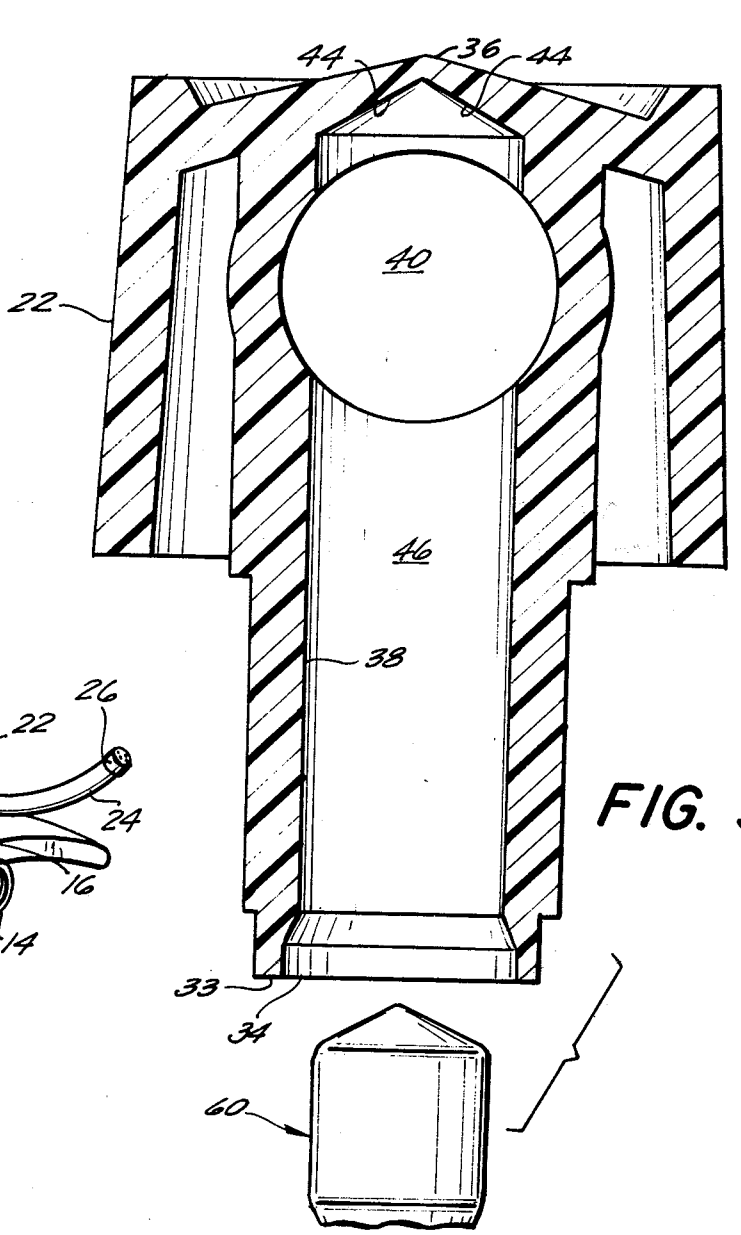
FIG. 3 is an end elevation view, partially in cross-section, taken along the line 3—3 of FIG. 2.
Figure 2:
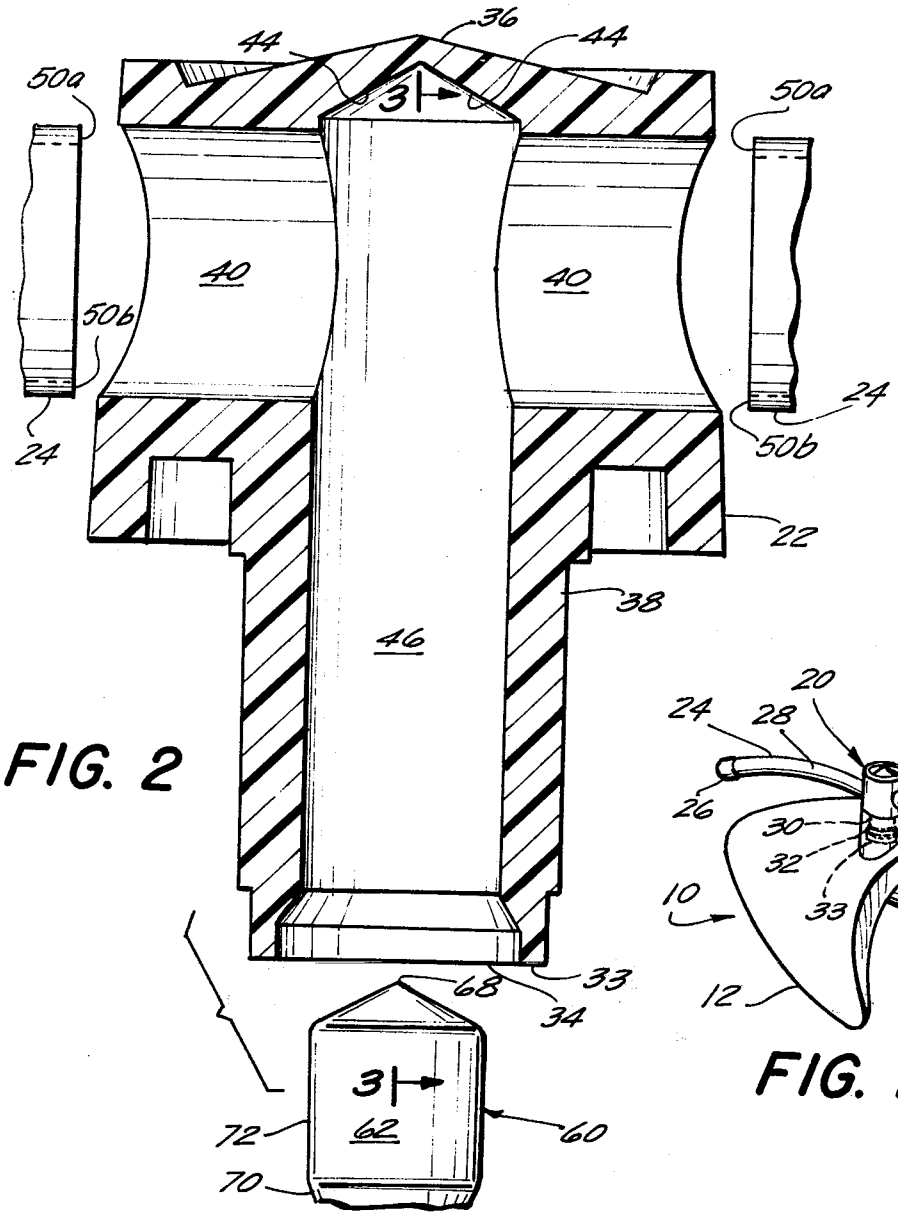
FIG. 2 is a side elevation view, partially in cross-section, of the rotor, with portions of the arms and flaring tool also being shown.

Referring now to FIGS. 2 and 3, therein illustrated is a hollow rotor 22 having an open end or bottom 34, a closed opposite end or top 36 and a sidewall 38 intermediate the ends 34,36. The sidewall 38 defines a plurality of apertures 40 therethrough, each of the apertures 40 being adapted to receive snugly a respective arm end 50. The inner surface of the sidewall 38 further defines adjacent each aperture 40 a recess 44 disposed intermediate the aperture 40 and the closed rotor end 36. Each recess 44 communicates with its respective aperture 40 and with each other recess 44. The apertures 40 are generally equidistantly spaced from one another along the circumference of the rotor 22, the apertures 40 being axially aligned where there are only two such apertures 40 in the rotor 22. Obviously the number of apertures 40 will be equal to the number of arms 24 to be included in the hub assembly 20. While in the embodiment illustrated there are but two apertures 40 in a common transverse plane (i.e., at a given level or height of the rotor 22), obviously there may be more in any given plane. Furthermore, the principles of the present invention are equally applicable to assemblies in which there are two or more apertures 40 disposed in each of a plurality of different transverse planes (i.e., levels or heights of the rotor 22), each of the apertures 40 being in fluid communication with the central longitudinal passageway 46 of the rotor 22.

Figure 11:
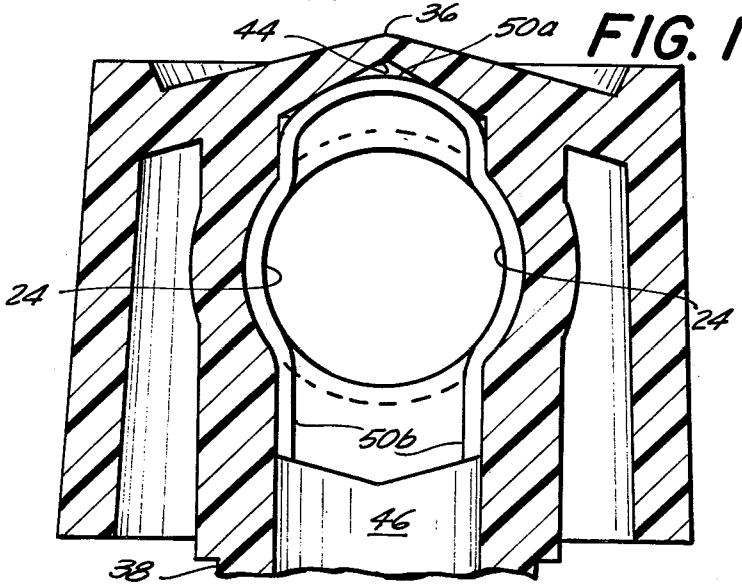
FIG. 11 is a fragmentary end elevation view, partially in cross-section, taken along the line 11—11 of FIG. 10.
Figure 10:
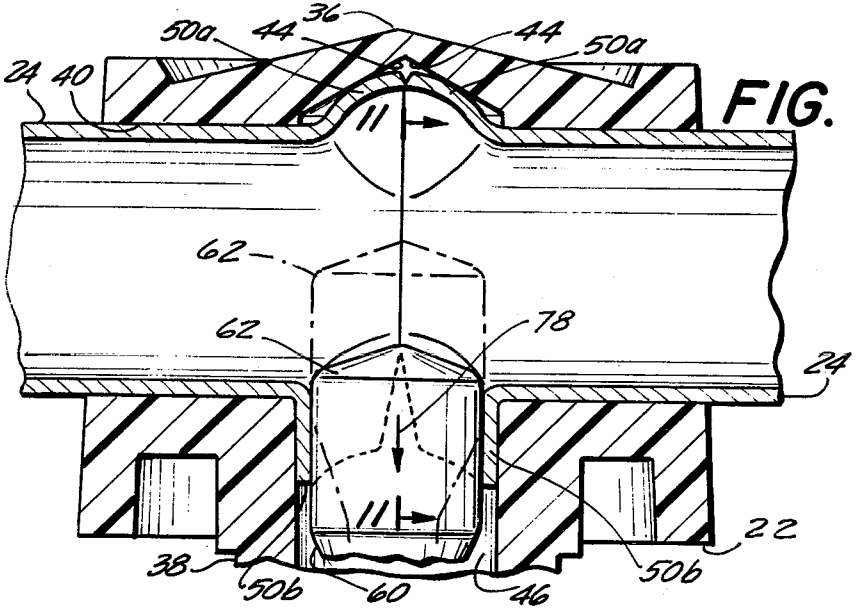
FIG. 10 is a fragmentary side elevation view, partially in cross-section, of the rotor and arms, with the flaring tool being shown in a partially lowered position in phantom line and a further lowered position in solid line.

Referring now to FIGS. 10 and 11, and ignoring temporarily the presence of the insertion tool 60 in these figures, each hollow arm 24 passes through its respective aperture 40 and has an outer end thereof (i.e., the end containing the nozzle 26) extending outwardly of the rotor 22 in a generally transverse direction and the inner end 50 thereof disposed within the rotor 22. The arm end 50 is flared outwardly to a diameter greater than that of the corresponding aperture 40 and has an upper end portion 50*a* at least partially disposed within the recess 44 adjacent the corresponding aperture 40. As the apertures 40 are all disposed in a common transverse plane and each of the recesses 44 are disposed on one side of the common transverse plane (that is, the upper side) and communicate with each other, the upper end portions 50*a* of the arms 24 abut one another to limit inward motion of the abutting arms 24 relative to the rotor 22. In other words, each upper end portion 50*a* is restrained from movement outwardly from the rotor 22 by virtue of its abutment against the recess 44 and from movement inwardly further into the rotor 22 by virtue of its abutment against the upper end portion 50*a* of another arm 24.

Each lower end portion 50*b* of an arm is angled downwardly so that it extends parallel to the abutting interior of sidewall 38. Retreat of a lower end portion 50*b* from the rotor 22 is precluded by the abutment of the lower end portion 50*b* against the interior of the sidewall 38.

Thus in the finished hub assembly 20, each arm end 50 disposed within the rotor 22 is flared outwardly to a diameter greater than that of the corresponding aperture 40 and precluded from withdrawal from the rotor 22 by virtue of the abutment of the upper end portion 50*a* against the recess 44 and the lower end portion 50*b* against the interior sidewall 38. Further inward motion of each arm end 50 relative to the rotor 22 is precluded by virtue of the abutment of the ends of the arms 24 against one another. While generally the lower end portions 50*b* will not abut one another, the upper end portions 50*a* and the portions intermediate the upper end portions 50*a* and the lower end portions 50*b* will abut, this being sufficient to preclude relative inward motion of the arms 24.

In order to unite the rotor 22 and arms 24 into an effectively unitary hub assembly 20, the present invention employs a flaring tool, generally designated 60 and illustrated in FIGS. 2–10. The flaring tool 60 comprises a flaring head 62, a base 64 and a connecting portion 66 intermediate the portions 62,64. The flaring head 62 includes a sharply inwardly inclined upper surface 68 adapted to force the upper end portions 50*a* into the recesses 44, a more gradually inclined lower surface 70, and an intermediate portion 72 which is cylindrical in configuration and of a diameter just slightly less than the diameter of the rotor passageway 46. The rotor 22 is held stationary by a conventional holding fixture (not shown).

Figure 4:
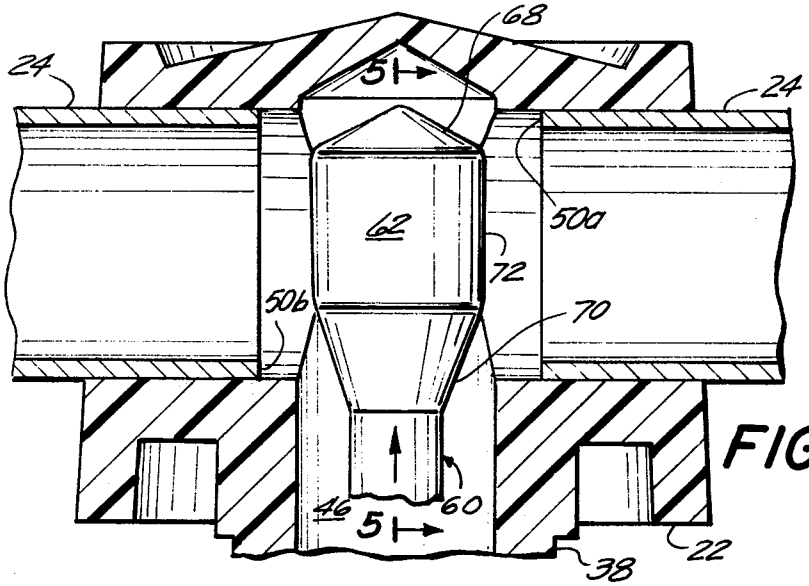
FIG. 4 is a fragmentary side elevation view, partially in cross-section, of the rotor with the flaring tool disposed therein and the arms approaching the flaring head.
Figure 5:
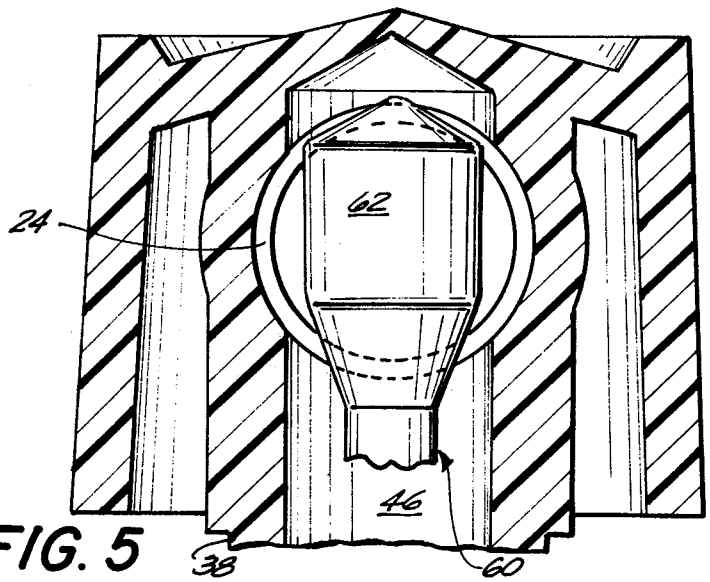
FIG. 5 is a fragmentary elevation view, partially in cross-section taken along the line 5—5 of FIG. 4.

Referring now to FIGS. 4 and 5 in particular, the flaring head 62 of the flaring tool 60 is first inserted into the rotor 22 through the open rotor end 34 and axial passageway 46 until the upper portion 68 thereof will intercept the upper ends portions 50*a* of the arms 24 and the lower portion 70 thereof will intercept the bottom end portions 50*b* of the arms 24. The intersection of the top portion 68 and the cylindrical portion 72 is disposed slightly below the inner surface of the top portion of the arms 24 and the intersection of the bottom portion 70 and the cylindrical portion 72 is spaced slightly above the inner surface of the bottom portions of the arms 24. Preferably the flaring head 62 is disposed in the common transverse plane defined by the apertures 40 and extends at least slightly to either side thereof so as to later effect outward flaring of the arm ends 50 relative to the longitudinal axis of the arm ends 50.

Figure 6:
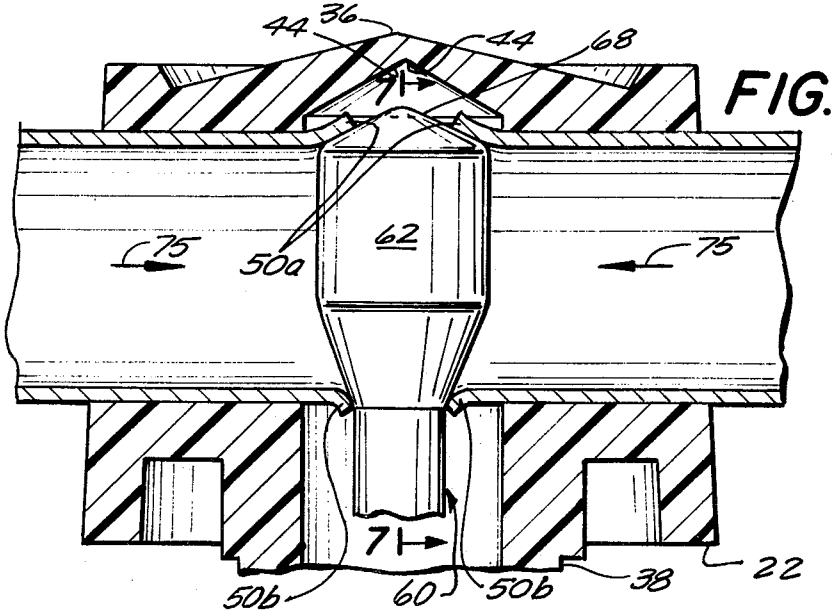
FIG. 6 is a fragmentary side elevation view, partially in cross-section, of the rotor with the flaring tool inserted therein and the arms being flared outwardly by the flaring tool head.
Figure 7:
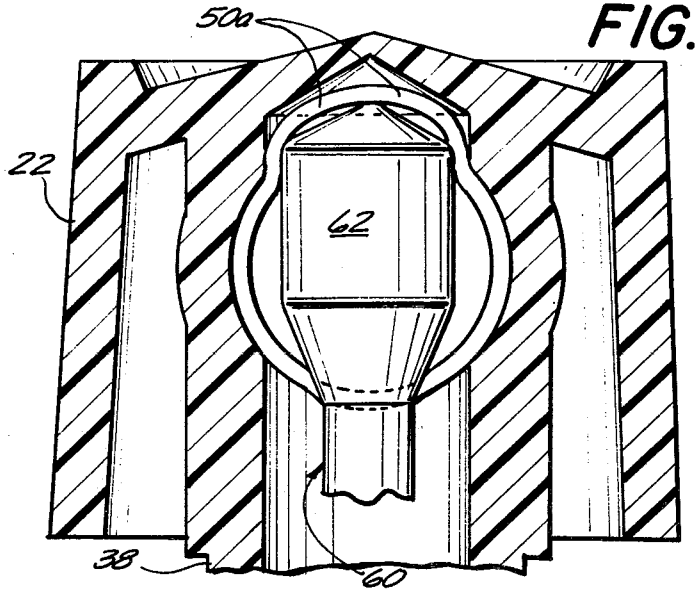
FIG. 7 is a fragmentary end elevation view, partially in cross-section, taken along the line 7—7 of FIG. 6.

Referring now to FIGS. 6 and 7 in particular, the arms are inserted through the apertures 40 and forced inwardly in the direction of arrows 75 by conventional means (not shown); for example, by means of movable split contoured jaws or vises. As the upper end portions 50*a* of the arms contact the upper portion 68 of the flaring head 62, they flare upwardly and outwardly relative to the arm axis, slightly into the recesses 44. Similarly, as the lower end portions 50*b* of the arms contact the lower portion 70 of the flaring head 62, they begin to flare downwardly and outwardly relative to the arm axis.

Figure 9:
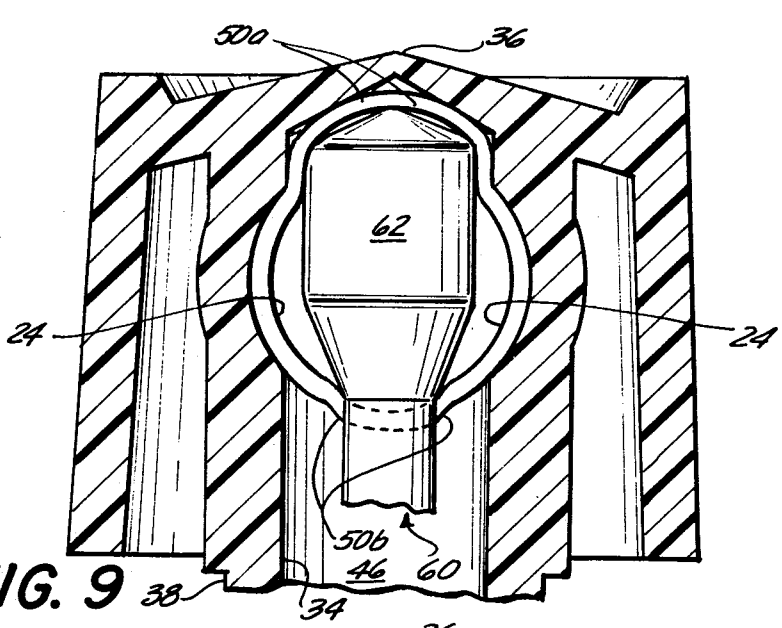
FIG. 9 is a fragmentary end elevation view, partially in cross-section, taken along the line 9—9 of FIG. 8.
Figure 8:
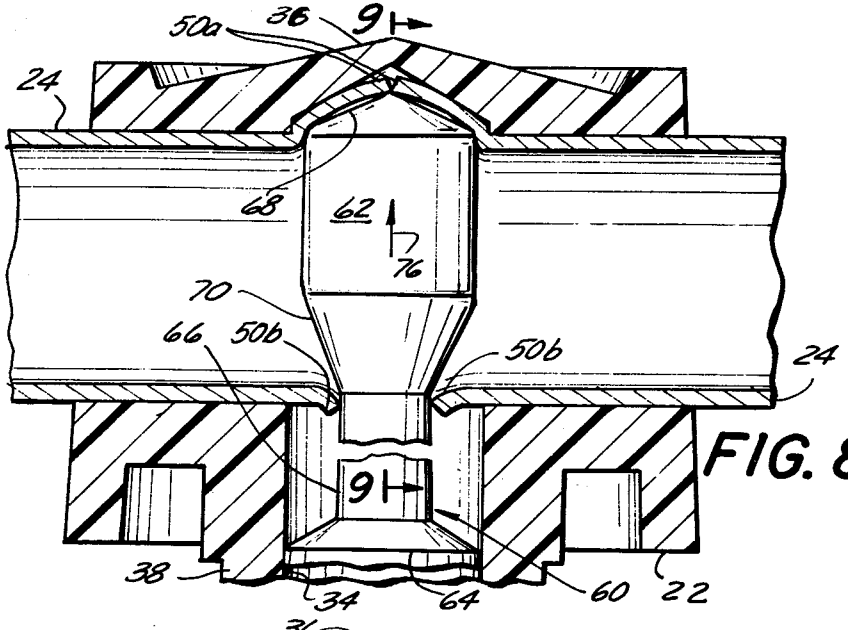
FIG. 8 is a fragmentary side elevation view, partially in cross-section, of the rotor after the flaring tool head has been advanced upwardly therein.

Referring now to FIGS. 8 and 9 in particular, after flaring has been achieved, the inward motion of the arms is terminated and the flaring tool 60 is moved upwardly (in the direction of arrow 76) toward the closed rotor end 36. The upward motion of the flaring head 62 forces the upper end portions 50*a* of the arms into the recesses 44 and causes them to abut.

Referring now to FIGS. 10 and 11 in particular, the flaring tool 60 is then forced downwardly (in the direction of arrow 78) toward the open rotor end 34. As the flaring head 62 moves from the position shown in phantom line in FIG. 10 downwardly to the more extreme position shown in solid line in FIG. 10, the cylindrical portion 72 of the flaring head 62 forces the lower end portions 50 of the arms substantially parallel to and against the interior of the sidewall 38 (i.e., perpendicular to the arm axes).

Eventually the entire flaring head 62 is removed from the rotor 22 through the open end 34, and the jaws (not shown) heretofore holding the arms 24 are removed. The hub assembly 20 may then be removed from the fixture (not shown) holding the rotor 22. As the upper end portions 50*a* of the arms have been deformed into a fluid-tight connection with the recesses 44 and the lower end portions 50*b* of the arms have been forced into a fluid-tight connection with the sidewall 38 of the rotor 22, there is no opportunity for fluid entering the passageway 46 to escape therefrom except through the arms 24.

In a preferred embodiment of the invention, the base 64 of the flaring tool may be seated upon conventional means for rotating the flaring tool 60 (for example, at about 1500 r.p.m.) to assist the flaring head 62 in extruding the arm ends 50; i.e., in causing flaring of the arm ends 50.

It will be appreciated that while movement of the flaring head 62 from its original position within the rotor (as shown in FIGS. 4 and 6) to its elevated position (as shown in FIG. 8) is desirable in that it insures a locking of the upper end portion 50*a* of the arms against the walls of the recesses 44, it is generally not a necessary step. Thus the flaring head 62 may be moved directly from its original position (as shown in FIG. 6) downwardly to its depressed position (as shown in FIG. 10). In this case, the lower end portions 50*b* of the arms are the prime elements preventing retreat of the arms from the rotor 22, with little if any assistance from the slightly upwardly bent upper end portions 50*a* of the arms. The abutment of the arms intermediate the upper and lower end portions 50*a*, 50*b* still serves to prevent further inward motion of the arms relative to the rotor 22.

It will be appreciated that while the figures show the rotor 22 as remaining in an upright position throughout the manufacturing process, it may be more convenient in certain instances to temporarily invert the rotor 22 so that the closed end thereof becomes the lower end, in which case the flaring head 62 is inserted and removed through the open and now upper end of the rotor 22.

To summarize, the present invention provides a hub assembly in which the arm/rotor interface is substantially fluid-tight, with motion of the arms relative to the rotor being substantially precluded, and a simple, inexpensive and relatively fail-proof method of assembling the same.

Now that the preferred embodiments of the present invention have been shown and described in detail, various modifications and improvements thereon will become readily apparent to those skilled in the art. For example, the principles of the present invention, though illustrated in the content of a rotating sprinkler, are equally useful in stationary sprinklers. Accordingly, the spirit and scope of the present invention is to be limited only by the appended claims and not by the foregoing disclosure.

I claim:

1. An arm/rotor hub assembly comprising

A. a hollow rotor adapted to receive a plurality of transversely-extending arms, said rotor having an open end, an opposite end, and a sidewall intermediate said ends, said sidewall defining a like plurality of apertures therethrough;

B. a plurality of hollow arms, each of said arms passing through a corresponding one of said apertures and having one end thereof extending outwardly of said rotor in a generally transverse direction and the other end thereof disposed within said rotor, said other end being flared outwardly to a diameter greater than that of said corresponding aperture and having a portion thereof at least partially disposed intermediate said corresponding aperture and said open rotor end.

2. The assembly of claim 1 wherein said rotor sidewall includes an inner surface defining a recess adjacent each of said apertures and each of said other arm ends includes a portion thereof at least partially disposed within said recess.

3. The assembly of claim 2 wherein each of said recesses communicates with its corresponding aperture.

4. The assembly of claim 2 wherein each of said recesses is disposed intermediate its corresponding aperture and said opposite rotor end.

5. The assembly of claim 2 wherein each of said recesses communicate with each other.

6. The assembly of claim 1 wherein each of said one arm ends comprises a nozzle in communication with the interior of said rotor.

7. An arm/rotor hub assembly comprising

A. a hollow rotor adapted to receive a plurality of transversely-extending arms, said rotor having an open end, an opposite end, and a sidewall intermediate said ends, said sidewall defining a like plurality of apertures therethrough disposed in a common transverse plane; and B. a plurality of hollow arms, each of said arms passing through a corresponding one of said apertures and having one end thereof extending outwardly of said rotor in a generally transverse direction and the other end thereof disposed within said rotor, said other being flared outwardly to a diameter greater than that of said corresponding aperture and having a portion thereof at least partially disposed intermediate said corresponding aperture and said open rotor end, said other end of one of said arms abutting said other end of at least one other of said arms to limit inward motion of said abutting arms relative to said rotor.

8. The assembly of claim 7 wherein portions of said other arm ends disposed to one side of said common transverse plane extend into said recesses and portions of said other arms disposed to the opposite side of said common transverse plane extend parallel to said rotor sidewall.

9. A method of assembling an arm/rotor hub assembly comprising the steps of

A. providing a hollow rotor adapted to receive a plurality of transversely-extending hollow arms, said rotor having an open end, an opposite end and a sidewall intermediate said ends, said sidewall defining a like plurality of apertures therethrough; and B. inserting one end of each hollow arm through a corresponding one of said apertures and against a flaring tool inserted into said rotor through said open rotor end to flare said one arm ends outwardly within said rotor to a diameter greater than said apertures and force portions of said one arm ends intermediate said apertures and said open rotor end.

10. The method of claim 9 wherein said flaring tool flares all of said one arm ends substantially simultaneously.

11. A method of assembling an arm/rotor hub assembly comprising the steps of A. providing a hollow rotor adapted to receive a plurality of transversely extending hollow arms, said rotor having an open end, an opposite end and a sidewall intermediate said ends, said sidewall defining a like plurality of apertures therethrough, said inner surface of said sidewall further defining a recess adjacent each of said apertures intermediate said apertures and said opposite rotor end; and B. inserting one end of each hollow arm through a corresponding one of said apertures and employing a flaring tool inserted into said rotor through said open rotor end to flare said one arm ends outwardly within said rotor to a diameter greater than said apertures and force portions of said one arm ends intermediate said apertures and said open rotor end and other portions of said one arm ends into said recesses intermediate said apertures and said opposite rotor end.

12. The method of claim 11 wherein said one arm ends are inserted in step (B) until said one arm ends flare outwardly and abut.

13. The method of claim 11 wherein said head is rotated during step (B).

14. The method of claim 11 wherein said portions of said one arm ends forced intermediate said apertures and said open rotor end in step (B) are forced to extend substantially parallel to said rotor sidewall.

15. A method of assembling an arm/rotor hub assembly comprising the steps of A. providing a hollow rotor adapted to receive a plurality of transversely-extending hollow arms, said rotor having an open end, an opposite end and a sidewall defining a like plurality of apertures therethrough in a common transverse plane;

B. inserting into said rotor through said open rotor end a flaring tool having a flaring head until said head is disposed in the common transverse plane and extends at least slightly to either side thereof;

C. inserting one end of each of said arms through a corresponding one of said apertures in said common transverse plane and against said head, thereby to flare outwardly within said rotor said one arm ends to a diameter greater than said apertures; and D. withdrawing said head from said rotor through said open rotor end, thereby to force portions of said one arm ends intermediate said apertures and said open rotor end.

16. The method of claim 15 wherein in step (A) said inner surface of said sidewall further defines a recess adjacent each of said apertures intermediate said aperture and said opposite rotor end; and between steps (C) and (D) said head is driven a limited distance in the direction of said opposite rotor end, thereby to force portions of said one arm ends into said recesses intermediate said apertures and said opposite rotor end.

17. The method of claims 15 or 16 wherein said one arm ends are inserted until said one arm ends flare outwardly and abut.

18. The method of claims 15 or 16 wherein said head is rotated during step (C).

19. The method of claims 15 or 16 wherein said portions of said one arm ends forced intermediate said apertures and said open rotor end in step (D) are forced to extend substantially parallel to said rotor sidewall.

* * * * *

UNITED STATES PATENT OFFICE

CERTIFICATE OF CORRECTION

Patent No. 4,193,549 Dated March 18, 1980

Inventor(s) JOSEPH GLADSTONE

It is certified that error appears in the above-identified patent and that said Letters Patent are hereby corrected as shown below:

Column 7, line 50, after "wherein" insert --said rotor sidewall includes an inner surface defining a recess adjacent each of said apertures, and--.

Signed and Sealed this

*Twenty-fourth* Day of *June 1980*

[SEAL]

*Attest:*

SIDNEY A. DIAMOND

*Attesting Officer*

*Commissioner of Patents and Trademarks*